US007501983B2

(12) United States Patent
Mikkola

(10) Patent No.: US 7,501,983 B2
(45) **Date of Patent: *Mar. 10, 2009**

(54) PLANAR ANTENNA STRUCTURE AND RADIO DEVICE

(75) Inventor: Jyrki Mikkola, Kaustinen (FI)

(73) Assignee: LK Products Oy, Kempele (FI)

( * ) Notice: Subject to any disclaimer, the term of this patent is extended or adjusted under 35 U.S.C. 154(b) by 18 days.

This patent is subject to a terminal disclaimer.

(21) Appl. No.: 10/753,885

(22) Filed: Jan. 7, 2004

(65) Prior Publication Data

US 2004/0145527 A1 Jul. 29, 2004

(30) Foreign Application Priority Data

Jan. 15, 2003 (FI) ..... 20030059
Jan. 22, 2003 (FI) ..... 20030093

(51) Int. Cl.
*H01Q 1/38* (2006.01)

(52) U.S. Cl. ..... 343/700 MS; 343/846; 343/745

(58) Field of Classification Search ..... 343/702, 343/700 MS, 718, 725, 846, 745
See application file for complete search history.

(56) References Cited

U.S. PATENT DOCUMENTS 4,800,392 A 1/1989 Garay et al.
5,926,139 A * 7/1999 Korisch ..... 343/702
6,034,637 A 3/2000 McCoy et al.
6,252,552 B1 * 6/2001 Tarvas et al. ..... 343/700 MS
6,304,220 B1 * 10/2001 Herve et al. ..... 343/700 MS
6,396,444 B1 5/2002 Goward et al.
6,404,394 B1 * 6/2002 Hill ..... 343/702
6,452,551 B1 9/2002 Chen
6,452,558 B1 * 9/2002 Saitou et al. ..... 343/725

(Continued)

FOREIGN PATENT DOCUMENTS

EP 0 923 158 A2 6/1999

(Continued)

OTHER PUBLICATIONS

A Finnish Search Report, dated Sep. 23, 2003, which issued during the prosecution of Finnish Application No. 20030093 which corresponds to the present application.

(Continued)

*Primary Examiner*—Don Wong
*Assistant Examiner*—Angela M Lie
(74) *Attorney, Agent, or Firm*—Darby & Darby P.C.

(57) ABSTRACT

A planar antenna structure intended to be used in small portable radio devices and a radio device using an antenna structure according to the invention. The radiating element (340) of the antenna is a conductive part in the cover of the radio device or a conductive coating attached to the cover. The radiating element is fed electro-magnetically by a parallel planar feed element (330) connected to the antenna port and located near the radiating element, between it and the ground plane (310). Between the feed element and antenna port there is a feed circuit (320) to provide matching for the antenna and, if necessary, forming an additional operating band. The radiating element need not be shaped to set the resonating frequencies or match the antenna. Instead, it can be designed relatively freely, based on the desired external appearance of the device, for example. Moreover the antenna requires relatively little space within the device.

11 Claims, 3 Drawing Sheets

U.S. PATENT DOCUMENTS

| | | | | |
|---|---|---|---|---|
| 6,459,413 | B1 * | 10/2002 | Tseng et al. | 343/702 |
| 6,469,673 | B2 * | 10/2002 | Kaiponen | 343/703 |
| 6,683,573 | B2 * | 1/2004 | Park | 343/700 MS |
| 6,717,551 | B1 * | 4/2004 | Desclos et al. | 343/700 MS |
| 6,759,989 | B2 * | 7/2004 | Tarvas et al. | 343/700 MS |
| 6,862,437 | B1 * | 3/2005 | McNamara | 455/188.1 |
| 2002/0053991 | A1 | 5/2002 | Lindell | |
| 2003/0146873 | A1 | 8/2003 | Blancho | |
| 2004/0140934 | A1 * | 7/2004 | Korva | 343/700 MS |
| 2004/0145525 | A1 * | 7/2004 | Annabi et al. | 343/700 MS |

FOREIGN PATENT DOCUMENTS

| | | | |
|---|---|---|---|
| EP | 1 067 627 | A1 | 1/2001 |
| EP | 1 094 545 | A2 | 4/2001 |
| EP | 1 098 387 | A1 | 5/2001 |
| EP | 1 162 688 | A1 | 12/2001 |
| EP | 1 248 316 | A2 | 10/2002 |
| EP | 1 271 690 | A2 | 1/2003 |
| JP | 10107671 | A1 | 4/1998 |
| JP | 11-127010 | A1 | 5/1999 |

OTHER PUBLICATIONS

A Finnish Search Report, dated Sep. 18, 2003, which issued during the prosecution of Finnish Application No. 20030059 which corresponds to the present application.

Patent Abstracts of Japan, vol. 1999, No. 10, Aug. 31, 1999, Application JP 11 127010 (Sony Corp.).

* cited by examiner

PLANAR ANTENNA STRUCTURE AND RADIO DEVICE

The invention relates in particular to a planar antenna structure intended to be used in small portable radio devices. The invention also relates to a radio device having an antenna according to the invention.

BACKGROUND OF THE INVENTION

In portable radio devices, mobile communication devices in particular, the antenna is preferably located within the covers of the device for user convenience. An internal antenna of a small-sized device is usually a planar type antenna because in that case it is easiest to achieve an antenna with satisfactory electrical characteristics. A planar antenna includes a radiating plane and a ground plane parallel thereto. FIG. 1 shows an example of a known internal planar antenna with its feed arrangement. Depicted in the figure there is a circuit board 101 of a radio device, which circuit board has a conductive upper surface. This conductive surface serves as a ground plane 110 in the planar antenna. At one end of the circuit board there is the radiating plane 130 of the antenna, which radiating plane lies above the ground plane, supported by a dielectric frame 150. For matching of the antenna there is at the edge of the radiating plane, near a corner thereof, a short-circuit conductor 121, which connects the radiating plane to the ground plane, and the antenna feed conductor 122. These conductors are in this example of one and the same metal plate with the radiating plane, each at the same time providing a spring by the force of which they are pressed against the circuit board 101 when the antenna is in use. For the feed conductor 122 there is a lead-through, isolated from the ground, to an antenna port on the lower surface of the circuit board. Antenna matching is provided through proper location of the feed and short-circuit conductors, design of the radiating plane, and potential additional components. The antenna may be arranged to have multiple operating bands by dividing the radiating plane into two branches of different electrical lengths as viewed from the short-circuit point by a nonconductive slot.

A disadvantage of the structure shown in FIG. 1 is that when trying to achieve a very small device, the space required by the radiating plane within the device may be too big. In principle this disadvantage could be avoided if the radiating plane were fabricated as part of the cover of the device. This, however, would restrict the design of the radiating element and thus make it more difficult to achieve the electrical characteristics desired.

In the prior art, antenna structures are known which include a surface radiator fed by a primary radiator. FIG. 2 shows an example of such a structure. A surface radiator 230 is attached onto the inner surface of the cover 250 of a device. The structure further includes a circuit board 202 parallel to the surface radiator, on that surface of the circuit board wich is visible in FIG. 2 being a strip-like feed conductor 216 of the antenna on the opposite side of the circuit board 202, i.e. on the surface facing the surface radiator, there is a conductive plane 210 with a slot-like nonconductive area 220. The center conductor of the feed line 205 is connected to the conductive strip 216 and the sheath to the conductive plane 210 which is thus connected to the signal ground. The antenna is matched by choosing appropriate dimensions for the circuit board 202 with its conductive parts. Moreover, dimensions of the structure are chosen such that the slot 220 resonates in the operating band and radiates energy to the surface radiator 230. As the surface radiator, in turn, resonates, it radiates radio-frequency energy into its surroundings.

Antennas like the one depicted in FIG. 2 are used in some mobile network base stations, for example. It is conceivable that such an antenna would be applied in mobile stations as well. An advantage of such a structure would be that the antenna could be matched without needing to shape the radiator proper. However, little or no space would be saved compared to the structure shown in FIG. 1. Furthermore, such an antenna structure would have only one operating band, which would be a disadvantage.

SUMMARY OF THE INVENTION

An object of the invention is to reduce said disadvantages associated with the prior art. A planar antenna structure according to the invention is characterized in that which is specified in the independent claim 1. A radio device according to the invention is characterized in that which is specified in the independent claim 13. Some preferred embodiments of the invention are specified in the other claims.

The basic idea of the invention is as follows: The radiating element of an antenna is a conductive part in the cover of the radio device or a conductive coating attached to the cover. The radiating element is fed electromagnetically by a parallel planar feed element connected to the antenna port and located near the radiating element between it and the ground plane. Between the feed element and antenna port, physically between the feed element and ground plane, there is a feed circuit by means of which the antenna is matched and, if necessary, an additional operating band is provided.

An advantage of the invention is that the radiating element need not be shaped in order to provide resonating frequencies or antenna matching. Instead, it can be designed relatively freely based on the desired external appearance of the device, for example. Another advantage of the invention is that the antenna needs relatively little space inside the device. This is based on the fact that the distance of the radiator from the ground plane can be considerably smaller than in a corresponding PIFA. A further advantage of the invention is that when the radiating element is located in/on the cover of the device, the radiating characteristics of the antenna are better compared to a radiator located more inwardly. A further advantage of the invention is that the production costs of the antenna according to the invention are relatively low.

BRIEF DESCRIPTION OF THE DRAWINGS

The invention is described in detail below. In the description, reference will be made to the accompanying drawings where.

DETAILED DESCRIPTION OF THE INVENTION

Figure 3:
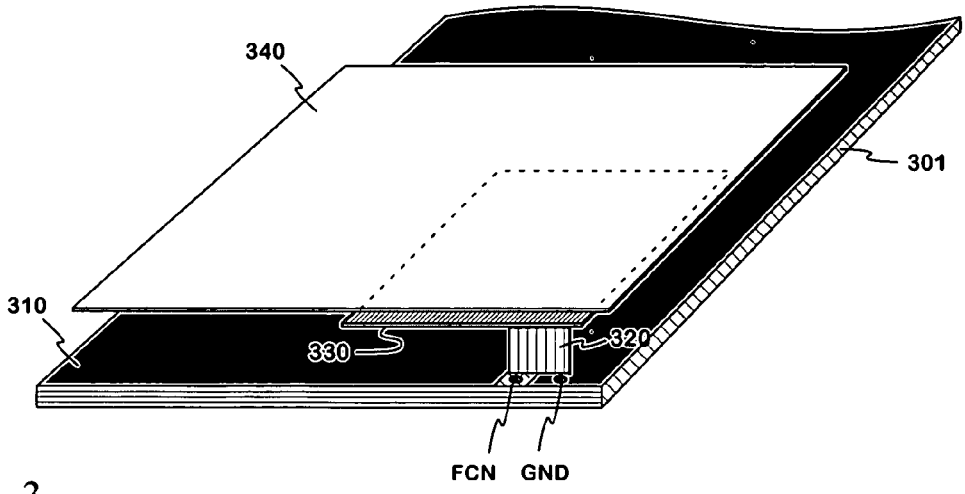
FIG. 3 shows the principle of a planar antenna structure according to the invention, FIGS. 4*a,b* show an example of an implementation of a planar antenna structure according to the invention.

FIG. 3 illustrates the principle of the planar antenna structure according to the invention. In the figure there is seen a circuit board 301 of a radio device, the conductive upper surface of the circuit board serving as signal ground and ground plane 310 for the antenna. Above the ground plane there is a parallel planar radiating element 340. Between the ground plane and radiating element, clearly closer to the latter than the former, there is a planar feed element 330. Its size is a fraction of the size of the radiating element. Between the radiating element and feed element exists only an electromagnetic coupling.

The antenna structure depicted in FIG. 3 further includes a feed circuit 320 which connects the feed element 330 to the antenna port of the radio device. The antenna port, in turn, is in connection with the transmitter and receiver in the radio device. The feed circuit has a galvanic contact to the signal ground GND. The antenna feed conductor comes from the feed circuit to the circuit board 301 at a point FCN. Together with the design of the feed element the feed circuit provides for the matching of the antenna and formation of the operating bands; there is thus no need to shape the radiator for these functions. The radiating element, feed element, feed circuit, and ground plane together form a resonator structure which has a resonating frequency that falls into the band of at least one radio system.

Figure 1:
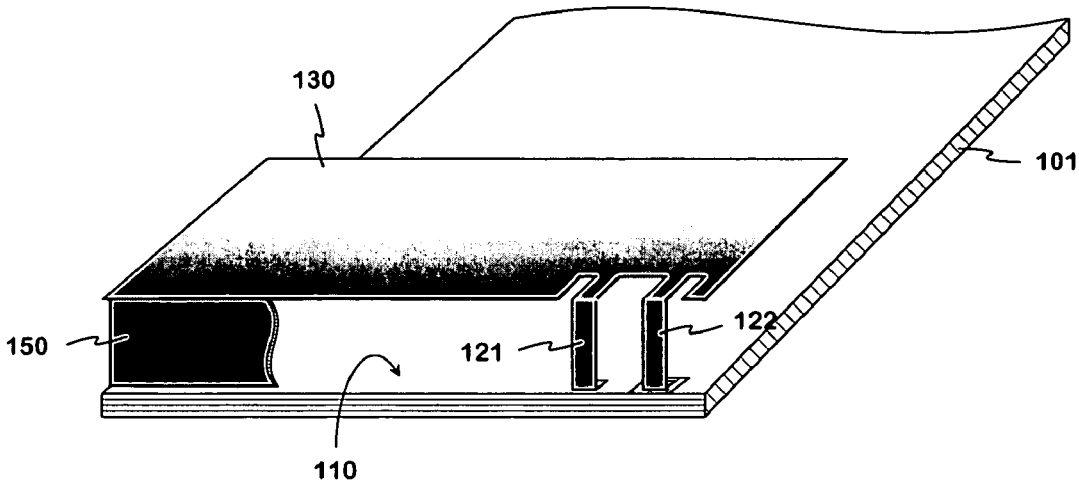
Fig. 1 PRIOR ART
FIG. 1 shows an example of a planar antenna structure according to the prior art.
Figure 2:
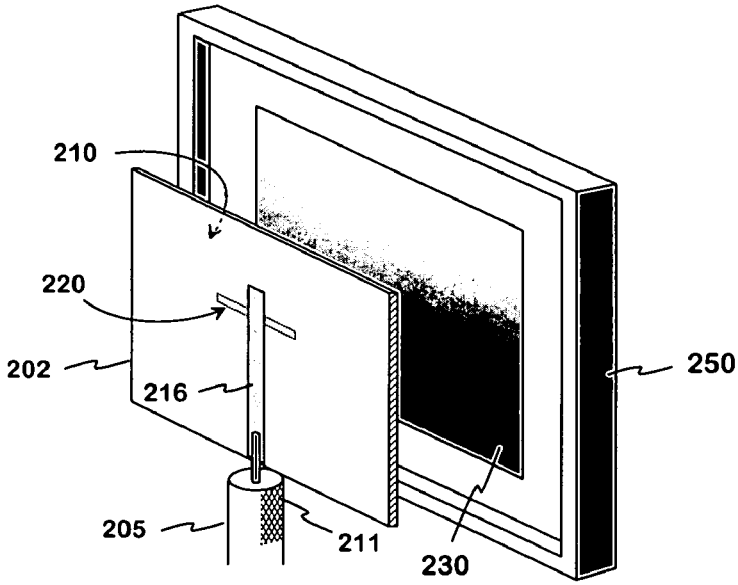
Fig. 2 PRIOR ART
FIG. 2 shows a second example of a planar antenna structure according to the prior art.
Figure 4A:
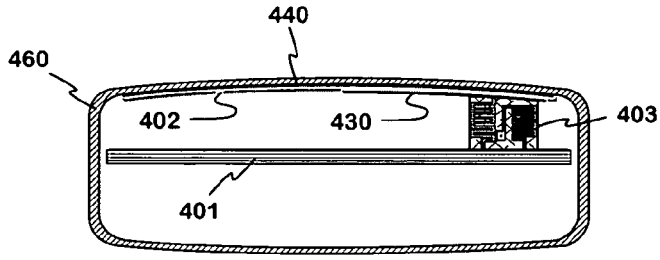

FIG. 4*a* shows a simplified cross section of a radio device using an antenna according to the invention. There is shown the cover 460 of the radio device and the circuit board 401 of the radio device, fixed either directly or indirectly to the cover. A radiating element 440, the width of which is nearly the same as the inner width of the radio device, is positioned against the inner surface of the cover 460. In this example case, the inner surface is slightly curved and the radiating element follows its contours. Under the radiating element there is a feed element 430. Between them there is a dielectric layer 402. In practice, it may be a flexible circuit board on opposing surfaces of which the elements are located, and which is attached to the cover of the radio device. The antenna feed circuit is located on a small feed circuit board 403 placed vertically between the feed element and circuit board 401. The arrangement according to FIG. 4*a* saves space because a radiating plane like the one depicted in FIG. 1 need not be placed within the inner space of the device, separated from the cover. Furthermore, because of the relatively large radiator, the distance between the ground plane and feed element can be left somewhat smaller than that between a ground plane and radiating plane in a corresponding PIFA structure.

Figure 4B:
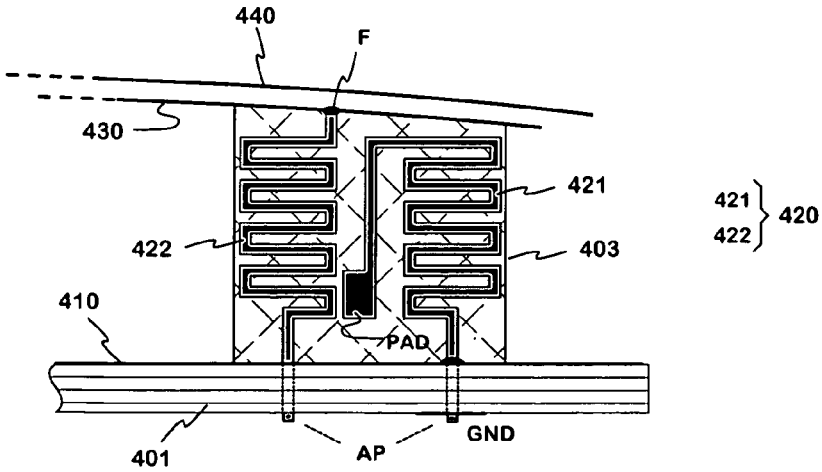

FIG. 4*b* shows an example of the feed circuit and its immediate surroundings enlarged. The feed circuit 420 comprises a ground conductor 421 and antenna feed conductor 422 which both are meandering strip conductors. The meander patterns are parallel on the feed circuit board 403. The feed conductor 422 is connected at its lower end to the antenna port AP and at its upper end galvanically to the feed element 430 at a feed point F. The ground conductor 421 is connected at its lower end to the ground plane 410 and to one terminal of the antenna port. At its upper end the ground conductor continues between said meander patterns back down and finally expands into a small conductive pad PAD right next to the lower edn of the meander pattern formed by the feed conductor. This way, the feed conductor 422 is at an intermediate point electromagnetically coupled to the ground conductor which is "seen" by the feed conductor as an inductive component grounded at the opposite end. Of course, the feed circuit can be designed in different ways. For example, the ground conductor may have a galvanic contact with the feed element as well. In that case, too, at least if we are referring to a multiband antenna, the ground conductor is not an ordinary short-circuit conductor because it is arranged to have reactance and a coupling to the feed conductor in order to provide for the operating bands and matching.

The circuit arrangement described above gives the antenna two clearly separate resonances and the corresponding operating bands even though neither the radiator 440 nor the feed element 430 has a slot pattern. The lower resonating frequency can be arranged to fall into the frequency area of GSM900 (Global System for Mobile telecommunications) and the upper resonating frequency into the frequency area of GSM1800, for example.

Figure 5:
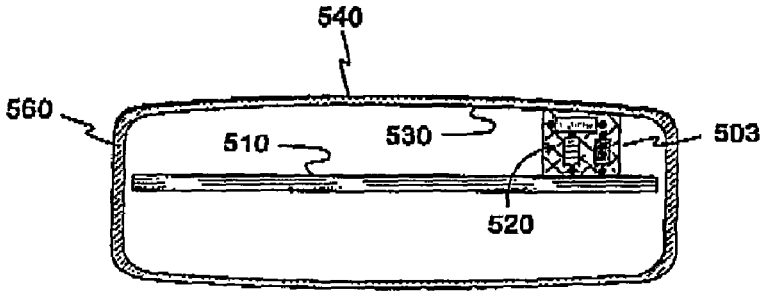
FIG. 5 shows a second example of an implementation of a planar antenna structure according to the invention.

FIG. 5 shows a second example of a planar antenna according to the invention with its feed circuitry. There is seen a similar simplified cross section of a radio device as in FIG. 4*a*. The difference from the structure depicted in FIG. 4*a* is that now the radiating element 540 is a conductive layer on the outer surface of the cover 560 of the radio device and the feed element 530 is a conductive layer on the inner surface of the cover 560. Thus the dielectric cover provides galvanic isolation between the elements in question. In this example the width of the radiating element equals to that of the whole radio device, even extending a little to the side surfaces. Such a size and the fact that there is only a very thin dielectric protective layer on top of the radiator, enhance the radiating characteristics. The radiating element can also be embedded within the cover in a manufacturing stage in which case there is no need for a special protective layer. The feed element, too, can be embedded within the cover. For the feed circuit there is in this case, too, a small circuit board 503 located between the feed element and ground plane. The difference between this and FIG. 4*a* is that the feed circuit 520 now includes discrete components. To avoid losses, these components are purely reactive, i.e. coils and capacitors.

Figure 6A:
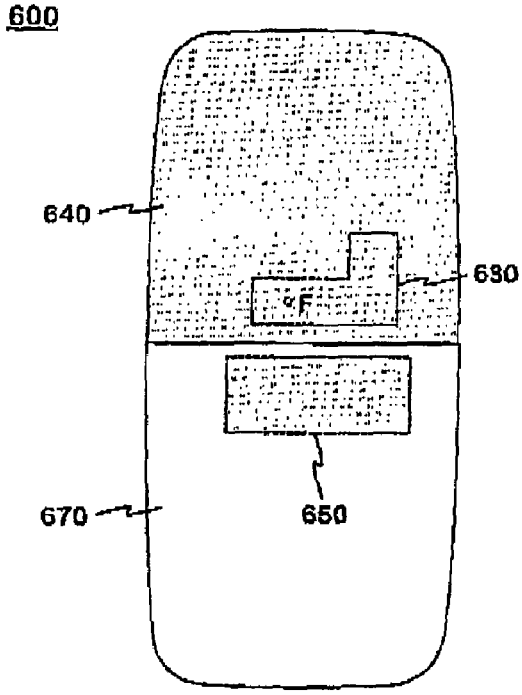
FIG. 6 shows a third example of an implementation of a planar antenna structure according to the invention.

FIGS. 6*a,b* show a third example of a planar antenna according to the invention. FIG. 6*a* shows a radio device 600, shaped like an ordinary mobile phone, seen from behind. In this example the upper portion 640 of the rear part of the cover of the radio device is made of a conductive material and serves as a radiating element. It is made of aluminum, for example by extruding. On the inner surface of the radiating element 640 there is a feed element 630, depicted in broken line, separated by a thin dielectric layer.

Figure 6B:
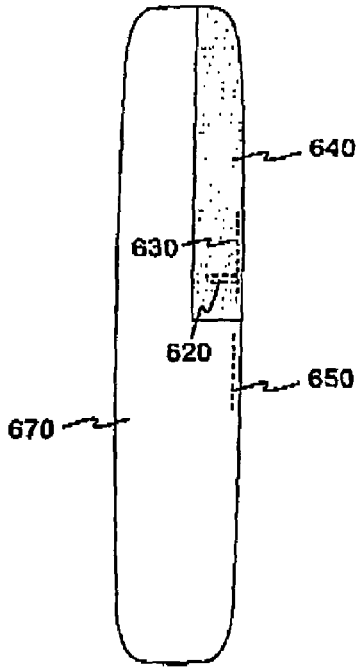

FIG. 6*b* shows the radio device of FIG. 6*a* seen from a side. The radiating element 640 is curved at its edges, forming also part of the side surfaces and end surface of the radio device. It is joined without discontinuity to the rest 670 of the cover of the radio device, said rest being made from dielectric material. The outer surface of the radiating element 640 is naturally coated with a thin non-conductive protective layer.

The attributes "lower", "upper" and "vertical" refer in this description and in the claims to the positions of the device as shown in FIGS. 3, 4*a*, 4*b*, and 5, and have nothing to do with the operating position of the devices.

Planar antennas and their feed arrangements according to the invention were described above. The shapes of antenna elements may naturally differ from those presented. Also the number of elements may vary because a parasitic radiator, for example, can be added in the antenna. The invention does not limit the fabrication method of the antenna. The surface elements joined to a dielectric intermediate layer or to the cover of the radio device may consist of some conductive coating such as copper or conductive ink. They may also consist of sheet metal or metal foil attached by means of ultrasound welding, upsetting, glueing or tapes. The different elements may have different fabrication and attachment methods. The inventional idea can be applied in different ways within the scope defined by the independent claim 1.

The invention claimed is:

1. A planar antenna structure for a radio device having at least one operating band comprising:

a ground plane;

a radiating element galvanically isolated from the ground plane and other conductive parts of the radio device;

a feed element having an antenna feed point, wherein the feed element is only electromagnetically coupled to the radiating element so as to transfer energy to the radiating element and receive energy from the radiating element;

a feed circuit that couples the antenna feed point to an antenna port of the radio device, wherein the feed circuit includes a reactive component and also couples the antenna feed point to the ground plane;

the feed circuit including a feed circuit board between the feed element and the ground plane, the feed circuit board including a feed conductor which galvanically connects said feed point to the antenna port;

wherein the feed conductor and the ground conductor are meandering strip conductors, which have certain inductances which act as the reactive component, and a ground conductor which electromagnetically connects the feed conductor to the ground plane at a point along the feed conductor;

whereby said at least one operating band is set to a desired range on the frequency axis so as to match the antenna.

2. A planar antenna structure according to claim 1, wherein the radiating element, when installed, follows the contours of the outer surface of the radio device as regards its shape and position.

3. A planar antenna structure according to claim 2, wherein the radiating element is a rigid conductive piece belonging to a cover of the radio device.

4. A planar antenna structure according to claim 3, wherein said conductive piece is an extrusion piece.

5. A planar antenna structure according to claim 1, further comprising a dielectric layer above the ground plane, the dielectric layer including a radiating element on one surface of said dielectric layer and a feed element on the opposing surface thereof.

6. A planar antenna structure according to claim 5, wherein a plate formed by said dielectric layer, radiating element and feed element is arranged to be attached to an inner surface of a non-conductive cover of the radio device.

7. A planar antenna structure according to claim 2, wherein the radiating element is a conductive layer on an outer surface of the cover of the radio device, and the feed element is a conductive layer on an inner surface of the cover of the radio device.

8. A planar antenna structure according to claim 2, wherein at least one of the radiating element and the feed element is located inside the cover of the radio device.

9. A planar antenna structure according to claim 1, further comprising at least one radiating parasitic element.

10. A radio device comprising:

a planar antenna structure, which has at least one operating band and comprises:

a ground plane;

a radiating element galvanically isolated from the ground plane and other conductive parts of the radio device;

a feed element having an antenna feed point, wherein the feed element is only electromagnetically coupled to the radiating element so as to transfer energy to the radiating element and receive energy from the radiating element; and a feed circuit that couples the antenna feed point to an antenna port of the radio device, wherein the feed circuit includes a reactive component and also couples the antenna feed point to the ground plane;

the feed circuit including a feed circuit board between the feed element and the ground plane, the feed circuit board including a feed conductor which galvanically connects said feed point to the antenna port;

wherein the feed conductor and the ground conductor are meandering strip conductors, which have certain inductances which act as the reactive component/and a ground conductor which electromagnetically connects the feed conductor to the ground plane at a point along the feed conductor;

whereby said at least one operating band is set to a desired range on the frequency axis so as to match the antenna.

11. A planar antenna structure for a radio device having at least one operating band comprising:

a ground plane;

a radiating element galvanically isolated from other conductive parts of the radio device;

a feed element, wherein the feed element is electromagnetically coupled to the radiating element to transfer energy to the radiating element and receive energy from the radiating element;

a feed circuit including a feed circuit board between the feed element and the ground plane, wherein the feed circuit includes a reactive component;

the feed circuit board including a feed conductor and a ground conductor, wherein the feed conductor and the ground conductor are meandering strip conductors, which have certain inductances to form said reactive component;

the ground conductor configured to electromagnetically couple the feed conductor to the ground plane at a point in the feed conductor; and the radio device including an antenna port;

wherein the feed circuit also connects an antenna feed point in the feed element to the antenna port;

whereby at least two operating band are provided.

* * * * *

UNITED STATES PATENT AND TRADEMARK OFFICE

CERTIFICATE OF CORRECTION

PATENT NO. : 7,501,983 B2
APPLICATION NO. : 10/753885
DATED : March 10, 2009
INVENTOR(S) : Jyrki Mikkola It is certified that error appears in the above-identified patent and that said Letters Patent is hereby corrected as shown below:

In the Title Page, Item (73) Assignee:

Please delete "LK Products Oy." and insert -- Pulse Finland Oy --

Signed and Sealed this

Fifth Day of January, 2010

David J. Kappos

David J. Kappos
*Director of the United States Patent and Trademark Office*